US008488986B2

(12) United States Patent
Dobbertin et al.

(10) Patent No.: US 8,488,986 B2
(45) Date of Patent: Jul. 16, 2013

(54) CONTROLLING SPEED TO REDUCE IMAGE QUALITY ARTIFACTS

(75) Inventors: Michael T. Dobbertin, Honeoye, NY (US); David J. Fuest, Warsaw, NY (US); W. Charles Kasiske, Jr., Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 308 days.

(21) Appl. No.: 12/915,364

(22) Filed: Oct. 29, 2010

(65) Prior Publication Data

US 2012/0107001 A1 May 3, 2012

(51) Int. Cl.
*G03G 15/20* (2006.01)

(52) U.S. Cl.
USPC ..... 399/68; 399/320; 399/322

(58) Field of Classification Search
USPC ..... 399/45, 67, 68, 320, 322, 324
See application file for complete search history.

(56) References Cited

U.S. PATENT DOCUMENTS 6,381,422 B1 * 4/2002 Tanaka ..... 399/45
6,892,047 B1 * 5/2005 Giannetti et al. ..... 399/400
2005/0220473 A1 * 10/2005 Bott et al. ..... 399/67

* cited by examiner

*Primary Examiner* — Walter L Lindsay, Jr.
*Assistant Examiner* — Roy Y Yi
(74) *Attorney, Agent, or Firm* — Raymond L. Owens

(57) ABSTRACT

A method for reducing artifacts on a toned sheet caused by buckling during fusing includes providing two compliant rollers that form a fusing nip for fusing the toned sheet. A control drives at least one of the rollers at a nominal speed to cause the rollers to rotate and there after increasing the roller speed to high speed prior to the sheet arriving at the fusing nip and after the sheet is in the nip decreasing the drive speed back to the nominal speed.

28 Claims, 7 Drawing Sheets

CONTROLLING SPEED TO REDUCE IMAGE QUALITY ARTIFACTS

FIELD OF THE INVENTION

This invention relates to an electrophotographic print engine. In particular, this invention relates to reducing artifacts when fusing a receiver bearing a dry toner image.

BACKGROUND OF THE INTENTION

In a dry electrophotographic print engine, a photoreceptive element is initially charged uniformly using known methods such as employing a grid controlled corona charger, or a roller charger. An electrostatic latent image is then formed on the photoreceptive element by image-wise exposing the photoreceptive element using known methods such as a light emitting diode (LED) array, a laser scanner, or an optical exposure system. The electrostatic latent image is then converted into a visible image by bringing the photoreceptive element into close proximity to marking or toner particles contained in a development station and biasing the development station so that the marking particles would be preferentially attracted to the latent-image bearing portions of the photoreceptive element and repelled by the portions of the photoreceptive element that do not bear latent image information. The toner is then transferred to a receiver such as paper, generally by pressing the paper into contact with the toned photoreceptive element while exerting an electrostatic field to urge the toner to the receiver. Alternatively, the toner can first be transferred to a transfer intermediate member and then from the intermediate member to the receiver.

Color images are made by making electrostatic latent images corresponding to the subtractive primary colors, cyan, magenta, yellow, and black, converting the electrostatic latent images into color images corresponding to those subtractive colors, and transferring the images, in register, either directly to a receiver or to an intermediate transfer member and then onto a receiver.

The toner or marking particles typically consist of dry particles comprising a polymer binder such as polyester or polystyrene, pigment or other colorant, surface treatment addenda such as nanometer-size clusters of silica, titania, or charge agents. Toner particles typically are between 4 μm and 8 μm in diameter, but may be larger (up to approximately 30 μm in diameter) or between approximately 1 μm and 4 μm. For the purpose of this invention, toner diameter refers to the volume weighted median diameter, as measured with a commercially available device such as a Coulter Multisizer or equivalent. The toner particles typically have a glass transition temperature $T_g$ between approximately 45° C. and 65° C., more typically between 50° C. and 60° C. For the purpose of this invention, toner or marking particles refer to the particles used to transform the electrostatic latent image into a toner image, often referred to as a visible image. The toner particles may contain a colorant such as a pigment or dye. Alternatively, the toner particles can be clear or absent any added colorant.

While monocomponent developers that do not comprise so-called carrier particles are used in dry electrophotographic print engines, it is more common to employ so called two-component developers. In this instance, the toner particles are mixed with magnetic particles, often referred to as carrier particles. The carrier particles are generally larger than the toner particles and are triboelectrically dissimilar to the toner particles so that the toner particles become electrically charged when contacting the carrier particles. The mixture of toner and carrier particles is often referred to as a two-component developer.

Two-component developers are used to transform the electrostatic latent image into a visible image by bringing the charged toner particles into close proximity to the electrostatic latent image bearing photoreceptive element, where the charged toner particles are attracted to the charge pattern making up the electrostatic latent image. The carrier particles are contained and transported by a development station comprising a so-called magnetic brush, as is known in the literature.

After transfer to the receiver, the toner image is fixed to the receiver by fusing. This is generally accomplished by subjecting the toner image bearing receiver to heat and pressure so that the toner is heated to a temperature above its $T_g$ while subjecting the toner image to pressure. This allows the toner to flow and to become permanently fixed to the receiver. In addition, if a color image has been printed, the subtractive primary colored toners flow together to create the full-color print. Application of heat and pressure to the toner image bearing receiver is generally accomplished by passing the receiver between two heated compliant rollers. The durameters of the rollers can vary significantly or be near equal to one another. Load applied between these two compliant rollers results in a fusing nip width that provides the dwell time for melting the toner. As the receiver enters the fusing nip, an increased load to the fuser drive system is created. This can cause the fuser rollers to slow down, thereby slowing the speed of the receiver. This causes the lead edge of the receiver to travel more slowly. If the trail edge of the receiver is driven at a higher speed with a force greater than the beam strength of the receiver, the receiver will buckle. This can cause physical print artifacts or degrade image quality. Moreover, the print engine speed may be altered by the mismatched fuser speed through the receiver coupling between them. These variations can result in nonuniform image gloss, streaks, incomplete fusing, hot or cold offset whereby toner that is either heated too much or too little transfers from the receiver to the fuser roller or color-to color misregistration. These effects can cause print artifacts and can result in damage or increased maintenance to the print engine.

SUMMARY OF THE INVENTION

In accordance with the present invention there is provided a method for reducing artifacts on a toned sheet caused by buckling during fusing, comprising:

- providing two compliant rollers that form a fusing nip for fusing the toned sheet;
- driving at least one of the rollers at a nominal speed to cause the rollers to rotate and there after increasing the roller speed to high speed prior to the sheet arriving at the fusing nip and after the sheet is in the nip decreasing the drive speed back to the nominal speed.

An advantage of the present invention is the reduction of sheet buckling by controlling the roller speed. This will reduce artifacts. A feature of the invention is that it can be achieved by simple use of roller speed control without involving the complexity of additional structure. This invention can be practiced without increasing the size of the electrophotographic print engine in order to accommodate different length receivers.

DETAILED DESCRIPTION OF THE INVENTION

Figure 1:
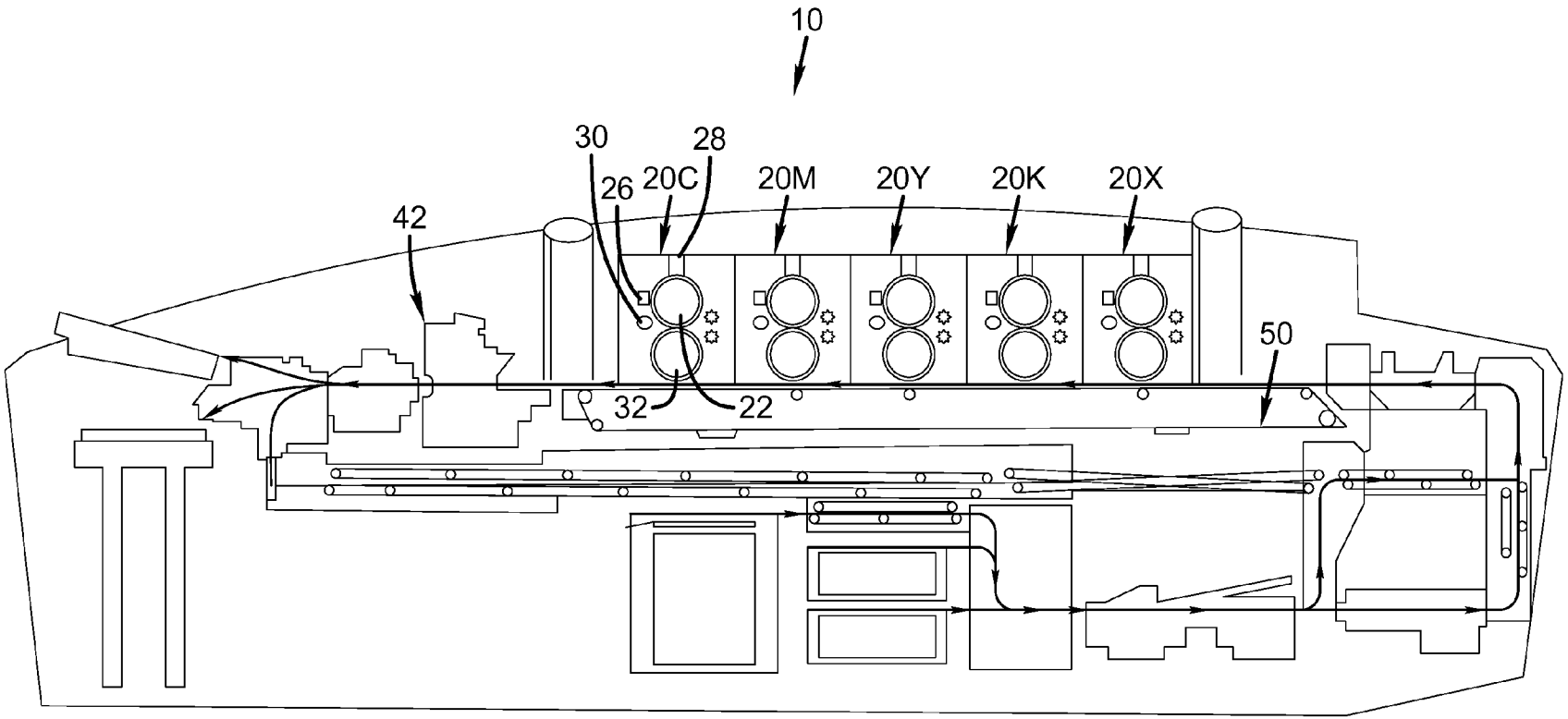
FIG. 1 PRIOR ART
FIG. 1 shows a typical prior art dry electrophotographic print engine in which the present invention can be employed.

FIG. 1 depicts a dry, color electrophotographic print engine, 10. There are imaging units for each color, 20C, 20M, 20Y, 20K, and 20X. In each imaging unit, there is a photoreceptive element 22 is initially charged uniformly using known methods such as employing a grid controlled corona charger 28 or a roller charger. An electrostatic latent image is then formed on the photoreceptive element by image-wise exposing the photoreceptive element using known methods such as an LED array 26, a laser scanner, or an optical exposure system. The electrostatic latent image is then converted into a visible image by bringing the photoreceptive element into close proximity to marking or toner particles contained in a development station 30 and biasing the development station so that the marking particles would be preferentially attracted to the latent-image bearing portions of the photoreceptive element and repelled by the portions of the photoreceptive element that do not bear latent image information. The toner may be transferred to an intermediate element 32. The toner is then transferred from either the photoreceptive element 22 or the intermediate element 32 to a receiver such as paper, generally by pressing the paper into contact with the toned photoreceptive element while exerting an electrostatic field to urge the toner to the receiver.

Color images are made by making electrostatic latent images corresponding to the subtractive primary colors, cyan, magenta, yellow, and black, converting the electrostatic latent images into color images corresponding to those subtractive colors, and transferring the images, in register, either directly to a receiver or to an intermediate transfer member and then onto a receiver. In a preferred embodiment, the receiver is transported between the imaging units on an electrostatic transport web 50 and delivered to the fusing subsystem, although other transport arrangements such as drums, vacuum, or grippers, may be employed. Alternatively, the receiver may be transported directly into the fuser by a transfer nip.

The toner or marking particles typically consist of dry particles comprising a polymer binder such as polyester or polystyrene, pigment or other colorant, surface treatment addenda such as nanometer-size clusters of silica, titania, or charge agents. Toner particles typically are between 4 μm and 8 μm in diameter, but may be larger (up to approximately 30 μm in diameter) or between approximately 1 μm and 4 μm. For the purpose of this invention, toner diameter refers to the volume weighted median diameter, as measured with a commercially available device such as a Coulter Multisizer or equivalent. The toner particles typically have a glass transition temperature $T_g$ between approximately 45° C. and 65° C., more typically between 50° C. and 60° C. For the purpose of this invention, toner or marking particles refer to the particles used to transform the electrostatic latent image into a toner image, often referred to as a visible image. The toner particles may contain a colorant such as a pigment or dye. Alternatively, the toner particles can be clear or absent any added colorant.

While monocomponent developers that do not comprise so-called carrier particles are used in dry electrophotographic print engines, it is more common to employ so called two-component developers. In this instance, the toner particles are mixed with magnetic particles, often referred to as carrier particles. The carrier particles are generally larger than the toner particles and are triboelectrically dissimilar to the toner particles so that the toner particles become electrically charged when contacting the carrier particles. The mixture of toner and carrier particles is often referred to as a two-component developer.

Two-component developers are used to transform the electrostatic latent image into a visible image by bringing the charged toner particles into close proximity to the electrostatic latent image bearing photoreceptive element, where the charged toner particles are attracted to the charge pattern making up the electrostatic latent image. The carrier particles are contained and transported by a development station comprising a so-called magnetic brush, as is known in the literature.

Figure 2:
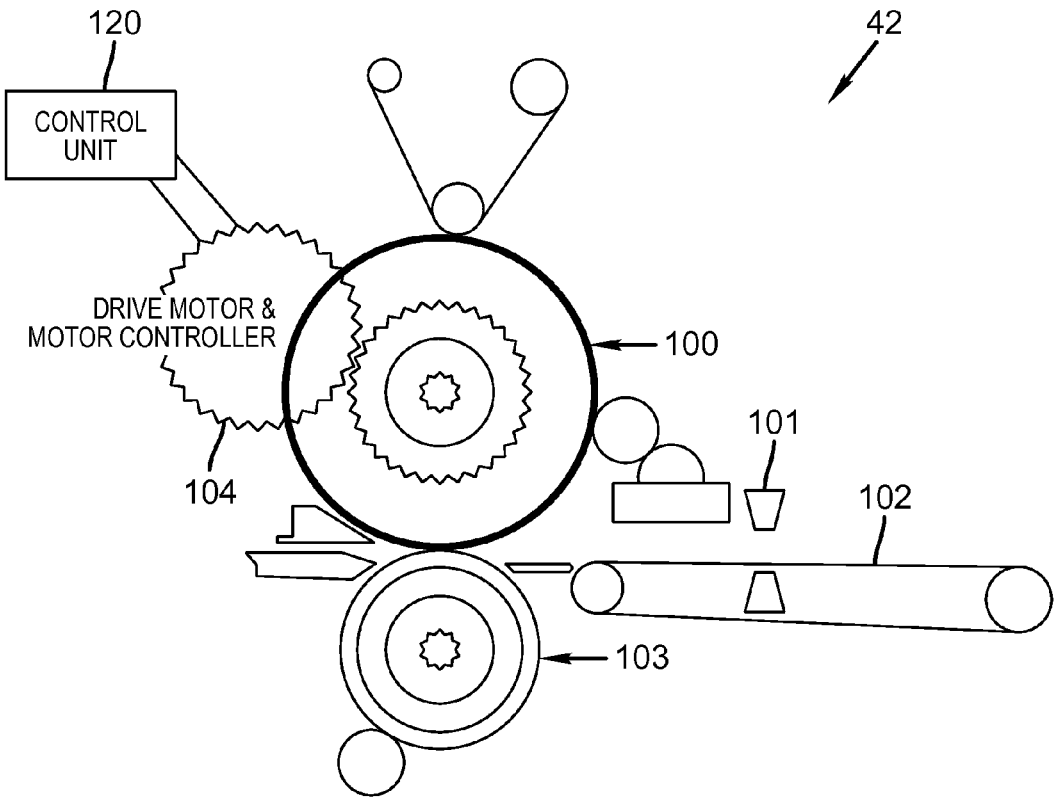
FIG. 2 shows a fuser typically prior art that can be used in practicing this invention.

After transfer to the receiver, the toner image is fixed to the receiver by fusing. This is generally accomplished by subjecting the toner image bearing receiver to heat and pressure so that the toner is heated to a temperature above its $T_g$ while subjecting the toner image to pressure. This allows the toner to flow and to become permanently fixed to the receiver. In addition, if a color image has been printed, the subtractive primary colored toners flow together to create the full-color print. This is generally accomplished by sandwiching the toner image bearing receiver between a pair of rollers that are pressed together, know as a fusing nip. A typical fuser system 42 is depicted in FIG. 2. The roller that contacts the freshly imaged side of the receiver is commonly referred to as the fusing roller 100. The opposite roller functions to apply pressure and is thus referred to as the pressure roller 103. In a preferred embodiment, this fusing roller is driven by an independent motor and controller 104 based on the speed profile calculated by the control unit 120. The pressure roller 103 is driven by the fusing roller 100. While this invention has been described in the context of a preferred embodiment as depicted in FIG. 2, it will be understood to apply to other known fusing configurations, such as belt fusers, comprised of a heated belt (or web) and a pressure roller.

Generally, there is limited control transport 102 such as a low pressure vacuum transport between the electrostatic transport web 50 and the fuser 42. If this transport is longer than the maximum receiver length, the fuser 42 is decoupled from the electrostatic transport web 50. This configuration greatly decreases the necessity to match speeds of the subsystems, but increases the overall size of the print engine. If the receiver is long enough such that it is still in control of the electrostatic transport web 50 when it enters the fuser 42 and the speed of the receiver in the fuser 42 is not exactly the same as the imaging unit transport speed at all times, the lead edge and trail edge of the receiver will be driven at different speeds.

If the speed of the receiver in the fuser 42 is slower than the portion on the electrostatic transport web 50 the receiver will buckle between the fuser 42 and the electrostatic transport web 50, if both are able to supply a drive force sufficient to buckle the receiver. If the speed of the receiver in the fuser 42 is greater than that on the electrostatic transport web 50, the lead edge will be driven faster than the trail edge. If this differential drive is larger than the slack or buckle in the receiver, the receiver will be in tension and there will be a force transmitted by the fuser 42 on electrostatic transport web 50. Either speed variation can result in variations of image gloss, streaks, incomplete fusing, hot or cold offset whereby toner that is either heated too much or too little transfers from the receiver to the fuser roller 100, or cause color-to color misregistration. These effects can cause print artifacts and can result in damage to the print engine.

Figure 3:
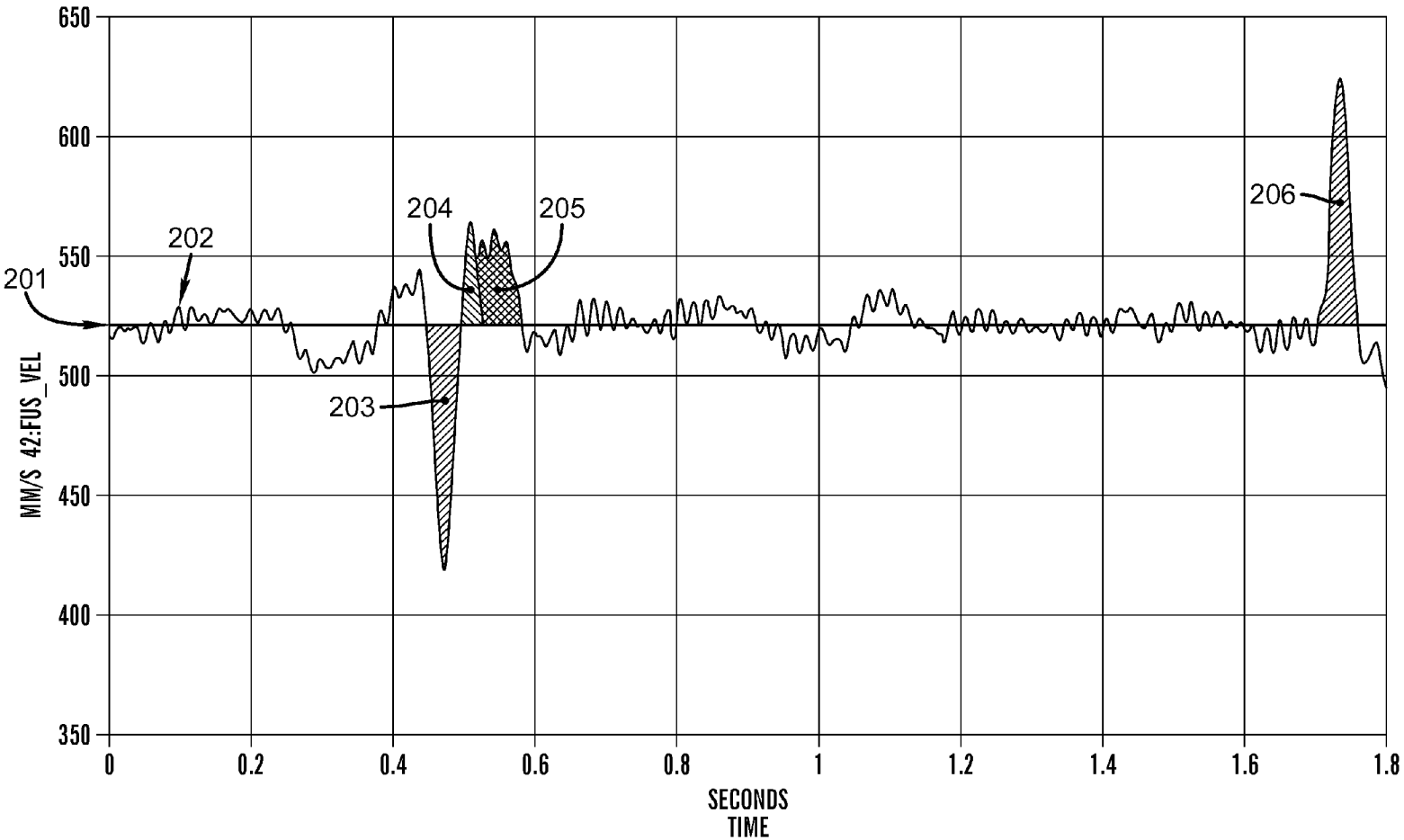
FIG. 3 PRIOR ART
FIG. 3 is a graph of the velocity of the fuser drive as a function of time, showing the swallowing and degorging cycles of a single heavy weight receiver.
Figure 4:
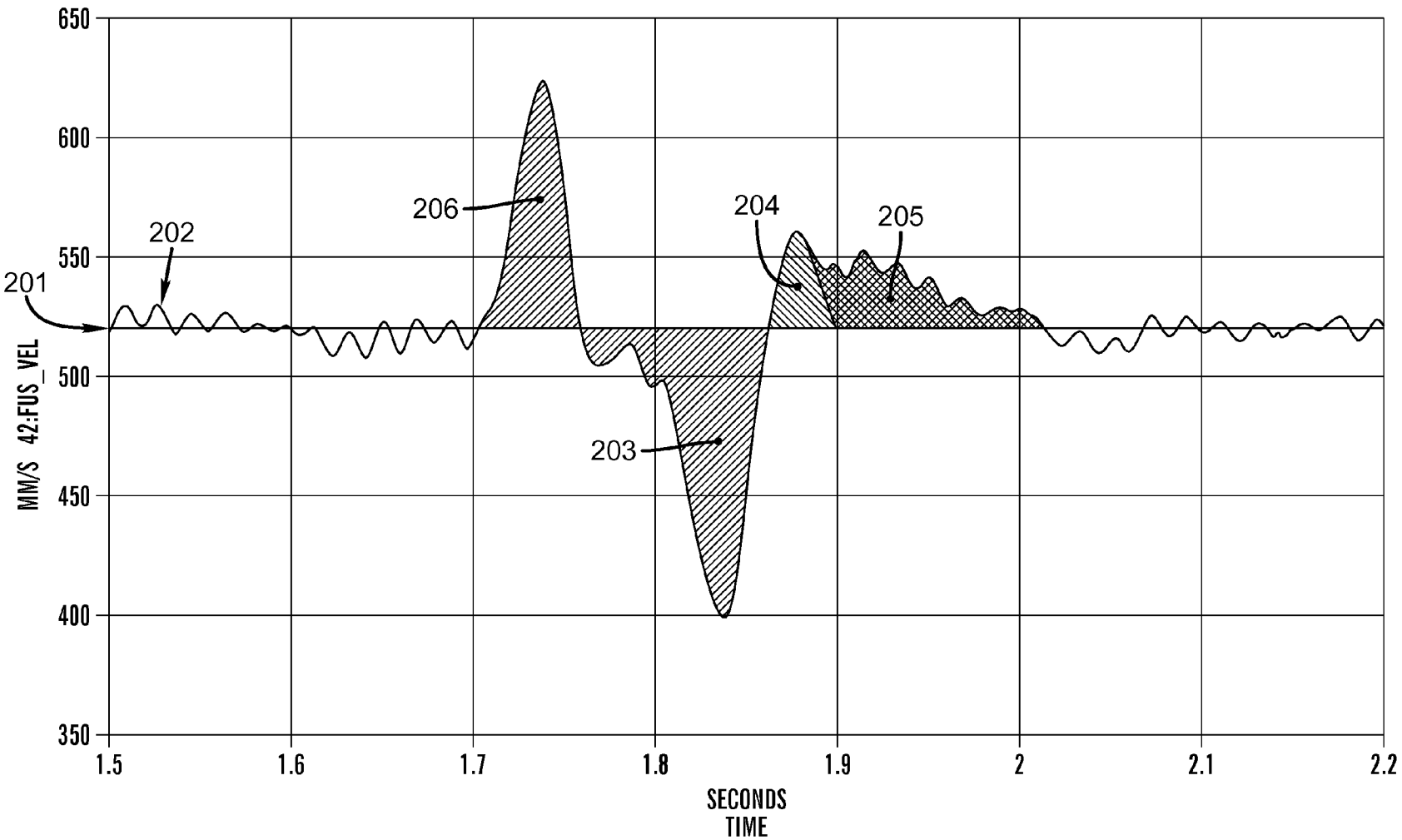
FIG. 4 PRIOR ART
FIG. 4 is a graph of the velocity of the fuser drive as a function of time, showing the degorge, swallow, interframe, and overshoot cycles, when running multiple heavy weight receivers

FIG. 3 depicts the typical velocity profile for a fuser roller 100 as a sheet enters and exits the fusing nip. The fuser motor and controller 104 is commanded to run at the nominal fuser motor speed 201. This nominal speed is generally close to the speed of the electrostatic transport web 50 but may be altered slightly in order to induce a controlled buckle, or increase the gap between sheets after they are released from the electrostatic transport web 50. This is shown as a reference along with the actual speed of the fusing roller 202 for a single sheet is shown as a function of time. The impact of the receiver entering the fuser nip can cause the fuser roller 100 to slow down for a period of time, thereby slowing the speed of the lead edge of the receiver. The speed in this time period can be in the range of 10-30% below the commanded speed. The difference between the nominal distance and the actual distance the receiver travels for this time period is defined as the swallowing loss 203. This swallowing loss 203 is a function of many factors including the fuser roller materials, pressure between the fuser roller 100 and the pressure roller 103, properties of the receiver such as caliper (or thickness), width (perpendicular to the transport direction), length, coating, gap between receiver sheets (interframe), the speed of the fuser roller 100, and the drive system characteristics such as inertia, motor torque, responsiveness or drive stiffness. The high speed command can be determined by the control unit 120 based on the above factors including properties of the receiver. The high speed and low speed command signals produced by the control unit 120 include duration and amplitude. Part, but generally not all, of the swallowing loss 203 is the result of the "elasticity" or stiffness of the drive system. Some of the kinetic energy is converted into potential energy stored in the drive system. This energy is subsequently released as the fusing roller 100 and receiver accelerate to a speed greater than the nominal fuser motor speed 201 for a period of time. The overshoot 204 is defined as the difference between nominal distance and the actual distance the receiver travels for this time period. This overshoot 204 decreases the buckle. A position control algorithm is frequently used by the fuser drive motor and controller 104 in order to provide the precision of drive required. As a result, the difference between the swallowing loss 203 and the overshoot 204 will be corrected in the position compensation portion 205 of the velocity profile. Essentially, the motor and controller 104 adjusts the speed to slightly higher than the nominal commanded speed to correct for the net difference in distance traveled. As the trail edge of the sheet exits the fuser 42, the speed of the fuser 42 and trail edge of the sheet increase. This is defined as degorging 206. The effect of the swallowing loss 203, overshoot 204, and position compensation portion 205 are superimposed on any commanded speed mismatch between the fuser roller 100 and electrostatic transport web 50. FIG. 4 is an enlarged view depicting a typical degorge, interframe between receiver sheets, receiver swallowing, and overshoot sequence for subsequent sheets.

Figure 5:
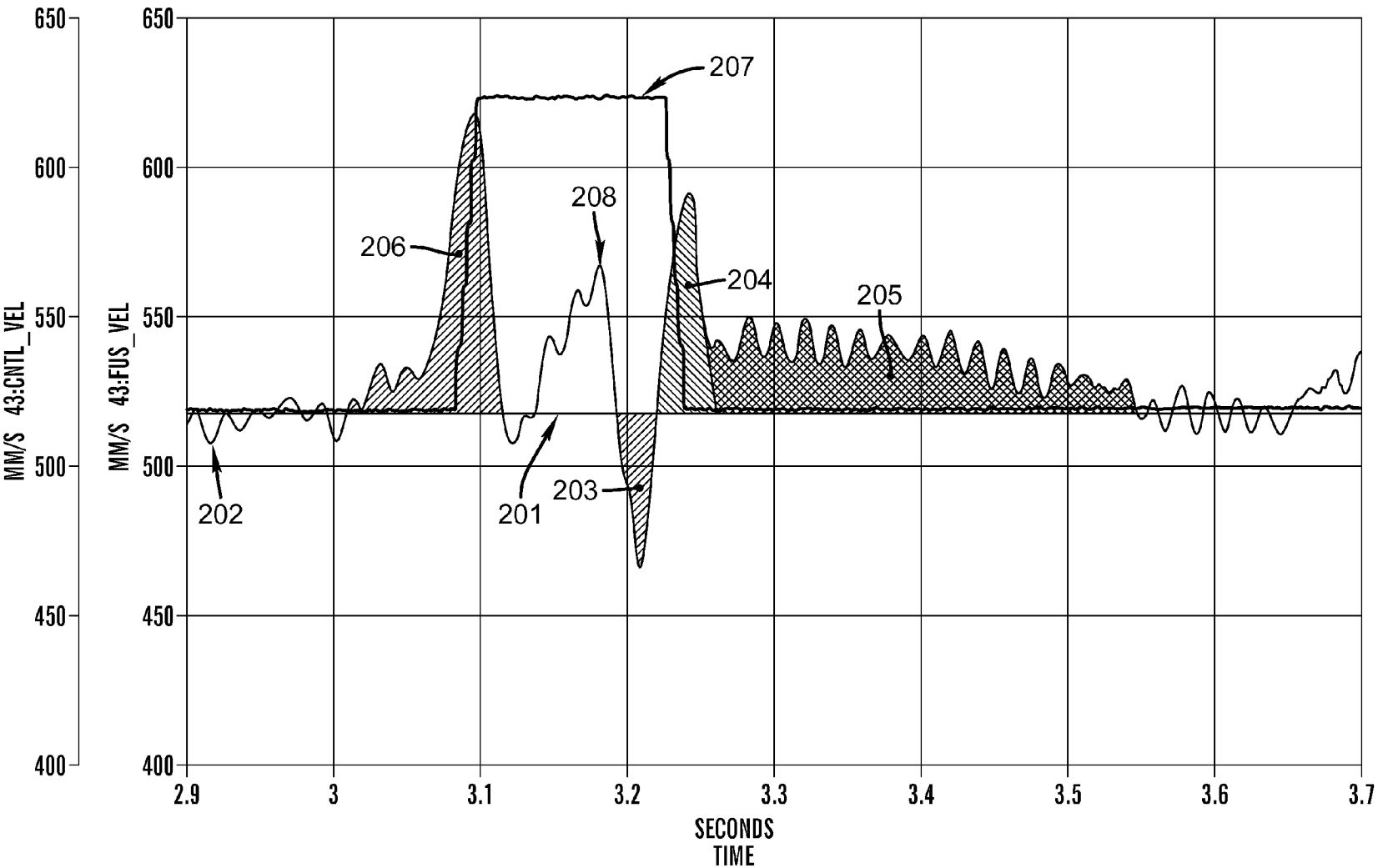
FIG. 5 is a graph of the velocity and commanded velocity of the fuser drive as a function of time, showing the degorge, swallow, interframe, and overshoot cycles, when running multiple heavy weight receivers and speed up of the fuser drive, as practiced in this invention.
Figure 7:
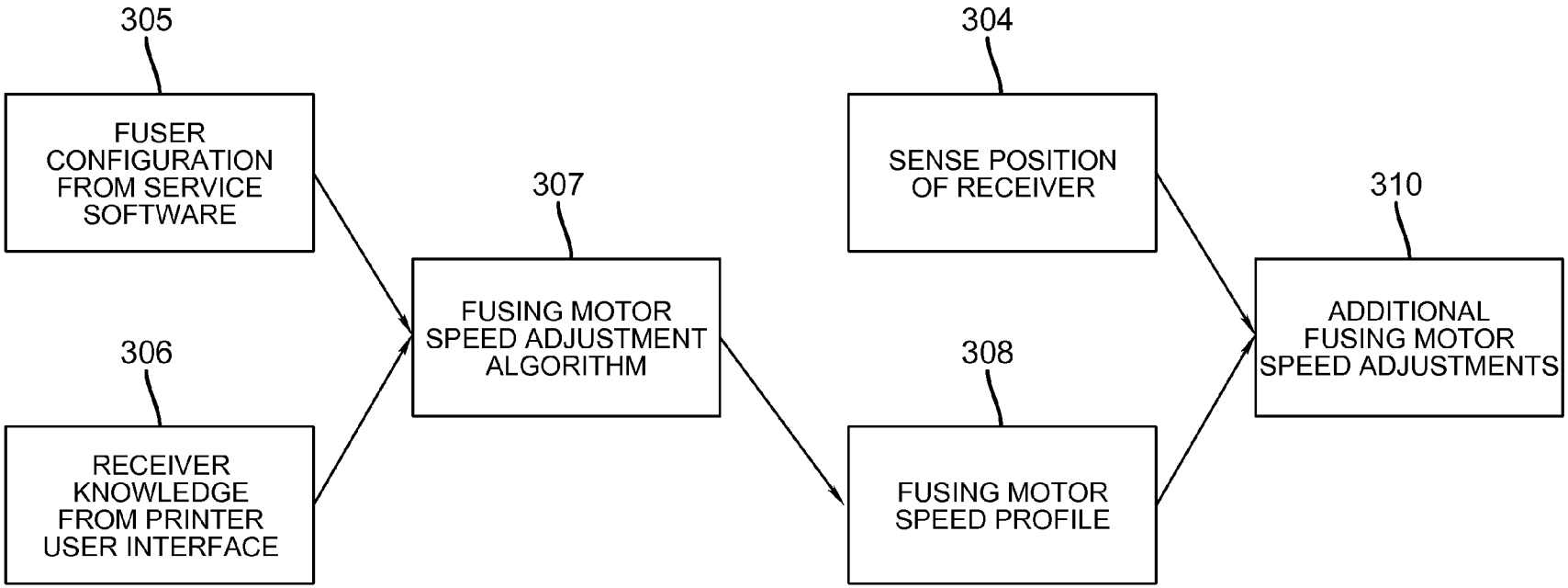
FIG. 7 is a block diagram illustrating a method of practicing this invention.

Increasing the inertia of the fuser system 42, drive motor torque, or drive system stiffness may decrease the swallowing loss 203. These modifications generally increase cost or power consumption. Another countermeasure is depicted in FIG. 5. Essentially, the control unit 120 increases the commanded speed of the fuser roller 100 to high fuser speed command 207 a speed greater than the nominal fuser motor speed 201 prior to the lead edge arriving so that the resulting minimum fuser roller speed is closer to the speed of the electrostatic transport web 50. The arrival time of the sheet may be predicted based on nominal sheet timing. Alternatively, the accuracy of this prediction can be improved by sensing the sheet arrival at a sensor or switch proceeding, but relatively close to, the fuser nip, similar to the vacuum transport switch 101 in FIG. 2. If a position control algorithm is used, this commanded speed may be significantly higher than the desired speed in order to exaggerate the position error, forcing a larger actual speed increase—with the given drive system. The control unit 120 then returns the high fuser command speed 207 to nominal fuser motor speed 201 after the swallowing loss 203 occurs. In a preferred embodiment, the high fuser command speed 207 is 10 to 30% above the nominal speed, initiated 50 to 100 milliseconds prior to the expected arrival of the lead edge of the receiver, resulting in an actual fuser roller speed increase of approximately 5 to 15%, to the fuser high speed actual 208. The resulting minimum speed of the fusing roller 100 would then be 5 to 20% lower than the nominal fuser motor speed 201. After 100 to 200 milliseconds, the command speed is returned from high speed 207 to nominal speed 201. This results in a reduced sheet buckle. A basic block diagram of the control unit used to accomplish these speed commands is depicted in FIG. 7.

Figure 6:
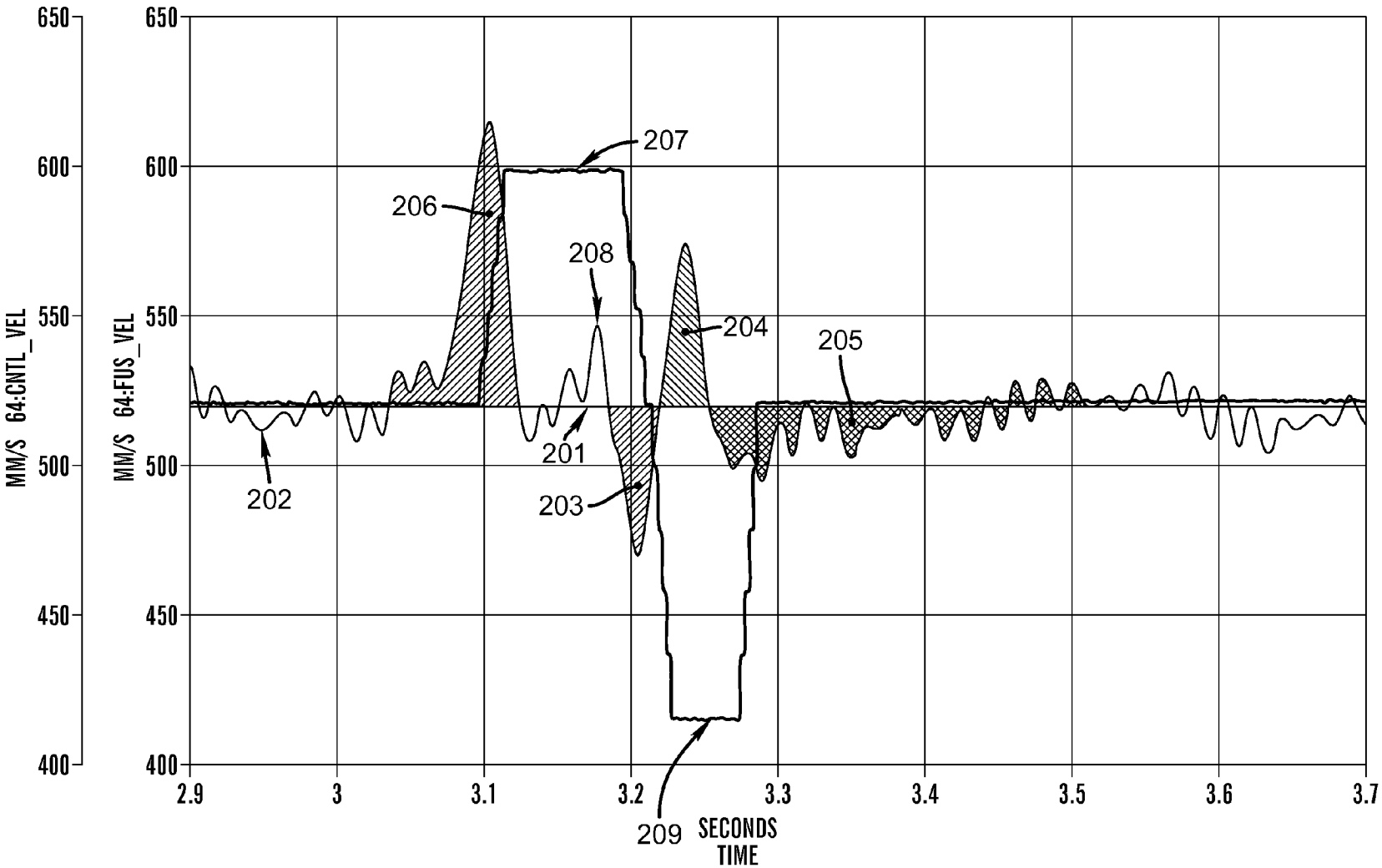
FIG. 6 is a graph of the velocity and commanded velocity of the fuser drive as a function of time, showing the degorge, swallow, interframe, and overshoot cycles, when running multiple heavy weight receivers and speed up and slow down of the fuser drive, as practiced in this invention.

Since the fuser motor and controller 104 is unable to fully attain the high commanded speed 207, the motor controller calculates a large position error, resulting a larger overshoot 204 and position compensation portion 205. If this occurs while the receiver is still adhered to the electrostatic transport web 50, the fuser 42 will pull the imaging unit transport after the remaining buckle in the receiver is consumed. A countermeasure for this is depicted in FIG. 6. In a preferred embodiment, the control unit 120 reduces the fuser motor speed command from the high speed 207 to a low speed 209 substantially below the actual speed 202. This low speed 209 may be in the range of 10-30% below the actual speed 202. The timing of this change to the fuser speed command may occur just as the sheet enters the fuser nip or at the minimum actual speed during the swallowing loss, so as to reduce the impending overshoot 204. The amplitude and duration of the low speed profile are chosen to balance the position error resulting from the combination of the degorging 206, high fuser speed command 207, swallowing loss 203, and overshoot 204. This will result in reduced position compensation 205 after the overshoot. Essentially, the net area between the actual speed profile and the desired speed profile for each sheet from the initiation of degorging until the completion of the overshoot is reduced. Similar to the high fuser speed command 207, the amplitude of the low speed command 209 is exaggerated to increase the reduction in fuser motor speed and the ensuing overshoot 204.

The torque and responsiveness of the drive system limit the amount the swallowing loss 203 can be reduced without increasing the overshoot 204 excessively. For this reason, it is important to balance the improvement in swallowing loss 203 with the increase in overshoot 204. Since the swallowing loss

203 is a function of the paper parameters and fuser configuration, it is desirable to modify the compensation based on these parameters.

FIG. 7 depicts a typical block diagram for this process. The control unit 120 can determine adjustments to the fuser motor speed through an algorithm, a look up table, or a combination. The control unit 120 combines the configuration and set point information 305 with the receiver information 306 using the fusing motor speed adjustment algorithm 307 to determine the desired fuser motor speed profile 308. Control unit 120 employs this profile 308 at the appropriate time based on the sheet timing 304 resulting in the fusing motor speed adjustments 310. As will be clear from FIGS. 5 and 6 in accordance with the invention, control unit 120 will command at least one of the rollers in the fusing nip to be driven at a nominal speed 201 to cause the rollers to rotate and there after increase the command speed to high fuser speed command 207 prior to the sheet arriving at the fusing nip and after the sheet is in the nip, reduce the command speed to low speed command 209, preferably reducing the drive speed of the roller below the nominal fuser motor speed 201 and then increasing the drive speed back to the nominal fuser motor speed 201. In some instance it is not necessary to reduce the drive speed of the roller below the nominal speed of the roller to reduce the image artifacts.

In a preferred embodiment, the amplitude or duration of the high fuser speed command 207, will be increased for receivers having greater thickness, or caliper. For instance, no high speed command may be necessary for receivers with a caliper less than a certain caliper in the range of 150 to 300 microns. The actual caliper threshold will be dependent on the fuser system configuration and setpoints. The adjustments may be made based on receiver weight rather than caliper if the relationship is known. Similarly, the magnitude of the swallowing loss 203 is proportional to the width of the receiver, so the magnitude of the high speed command may be increased for wider receivers. The swallowing loss 203 is also affected by the timing of the sheet arrival relative to the release of the previous sheet. This timing is a function of the fuser speed, fuser nip width, and interframe spacing between the sheets, which is affected by the sheet length (parallel to feed direction). For this reason, the high speed command 207 may be modified depending on these parameters. The first sheet in the set is a special case in which the interframe is essentially infinite and may be treated differently from the other sheets in the run.

The swallowing loss 203 is a function of the force in the fusing nip. The higher the force for a given configuration, the greater the swallowing loss will be. To compensate for this in variable force systems, the control unit 120 may modify the fuser motor speed adjustments 310 based on the fuser nip force, with greater compensation preferred for higher fuser nip forces. Similarly, the compensation may be adjusted for different fuser roller 100 and pressure roller 103 designs, as well as different drive systems.

Since the magnitude of the overshoot 204 increases as the swallowing loss 203 increases, the low fuser speed command 208 may be adjusted when the high speed command 207 is modified. This may or may not be done proportionally, depending on the configuration.

The invention has been described in detail with particular reference to certain preferred embodiments thereof, but it will be understood that variations and modifications can be effected within the spirit and scope of the invention Parts List

10 color electrophotographic print engine
20C color
20K color
20M color
20Y color
20X color
22 photoreceptive element
26 led array
28 grid controlled corona charger
30 development station
32 intermediate element
42 fuser
50 electrostatic transport web
100 fuser roller
101 vacuum transport switch
102 limited control transport
103 pressure roller
104 motor and controller
120 control unit
201 nominal fuser motor speed
202 actual speed
203 swallowing loss
204 ensuing overshoot
205 position compensation portion
206 degorging
207 high fuser speed command
208 fuser high speed actual
209 low speed
304 sheet timing
305 set point information
306 receiver information
307 fusing motor speed adjustment algorithm
308 desired fuser motor speed profile
310 fuser motor speed adjustments

The invention claimed is:

1. A method for reducing artifacts on a toned sheet caused by buckling during fusing, comprising:

providing two compliant rollers that form a fusing nip for fusing the toned sheet;

driving at least one of the rollers at a nominal speed to cause the rollers to rotate and there after increasing the roller speed to high speed prior to the sheet arriving at the fusing nip and after the sheet is in the nip decreasing the drive speed back to the nominal speed.

2. The method according to claim 1 wherein at least one of rollers in the fuser is compliant.

3. The method according to claim 1 wherein the time of arrival of the sheet in the fusing nip is determined by a receiver sensor.

4. The method according to claim 1 further including sensing the position of the toned sheet prior to arrival at the fusing nip to cause the speed of the roller to increase to high speed.

5. The method according to claim 4 wherein the commanded high speed is 10% to 30% above the nominal speed.

6. The method according to claim 1 wherein the commanded high speed is 10% to 30% above the nominal speed.

7. The method according to claim 1 whereby the roller speed increase to high speed is initiated 50 to 100 milliseconds prior to the arrival of the sheet at the fusing nip.

8. The method according to claim 1 wherein the roller speed high speed is maintained for 100 to 200 milliseconds.

9. The method according to claim 1 wherein the increase in the roller speed is based on one or more of the properties of a receiver.

10. The method according to claim 9 wherein the increase in the roller speed is determined from the thickness of the receiver.

11. The method according to claim 9 wherein the increase in the roller speed is determined from the weight of the receiver.

12. The method according to claim 9 wherein the increase in the roller speed is determined from a coating of the receiver.

13. The method according to claim 9 wherein the fuser speed is adjusted according to the receiver length.

14. The method according to claim 9 wherein the roller speed is adjusted according to the receiver width.

15. The method according to claim 1 wherein the roller speed is adjusted according to the gap between receiver sheets.

16. The method according to claim 1 wherein the duration of the high speed in the roller speed is based on one or more of the properties of the receiver.

17. The method according to claim 16 wherein the increase in the roller speed is determined from the thickness of the receiver.

18. The method according to claim 16 wherein the increase in the roller speed is determined from the weight of the receiver.

19. The method according to claim 16 wherein the increase in the roller speed is determined from the type of receiver.

20. The method according to claim 16 wherein the roller speed is adjusted according to the receiver length.

21. The method according to claim 16 wherein the fuser speed is adjusted according to the receiver width.

22. The method according to claim 16 wherein the duration of the roller speed increase is adjusted according to the gap between receiver sheets.

23. The method according to claim 1 wherein a receiver is transported from imaging unit to the fusing nip using a vacuum transport.

24. The method according to claim 1 wherein the roller speed is controlled by a control unit.

25. A method for reducing artifacts on a toned sheet caused by buckling during fusing, comprising:

providing two compliant rollers that form a fusing nip for fusing the toned sheet;

driving at least one of the rollers at a nominal speed to cause the rollers to rotate and there after increasing the roller speed to high speed prior to the sheet arriving at the fusing nip and after the sheet is in the nip, reducing the drive speed of the roller below the nominal speed and then increasing the drive speed back to the nominal speed.

26. The method according to claim 25 wherein the roller is slowed to a speed below the imaging unit transport speed.

27. The method according to claim 25 wherein the decrease in the roller speed once the receiver has entered the fusing nip is based on the increase in roller speed prior to the arrival of the sheet.

28. The method according to claim 25 wherein the roller speed is adjusted according to the force in the fusing nip.

* * * * *